US008061794B2

(12) United States Patent
London et al.

(10) Patent No.: US 8,061,794 B2
(45) Date of Patent: Nov. 22, 2011

(54) METHOD AND APPARATUS FOR SPOOFING IMAGING DEVICES

(75) Inventors: William L. London, Sanford, NC (US); Steven R. Quinley, Hillsborough, NC (US)

(73) Assignee: Static Control Components, Inc., Sanford, NC (US)

( * ) Notice: Subject to any disclaimer, the term of this patent is extended or adjusted under 35 U.S.C. 154(b) by 98 days.

(21) Appl. No.: 12/195,644

(22) Filed: Aug. 21, 2008

(65) Prior Publication Data

US 2009/0015607 A1 Jan. 15, 2009

Related U.S. Application Data

(63) Continuation of application No. 11/588,485, filed on Oct. 27, 2006, now Pat. No. 7,419,234.

(51) Int. Cl.
*B41J 2/195* (2006.01)

(52) U.S. Cl. ..... 347/7; 347/19

(58) Field of Classification Search ..... 347/7
See application file for complete search history.

(56) References Cited

U.S. PATENT DOCUMENTS

| | | | | |
|---|---|---|---|---|
| 5,757,390 | A * | 5/1998 | Gragg et al. | 347/7 |
| 6,000,773 | A | 12/1999 | Murray | |
| 6,089,687 | A * | 7/2000 | Helterline | 347/7 |
| 6,155,664 | A * | 12/2000 | Cook | 347/7 |
| 7,101,012 | B2 | 9/2006 | Kosugi | |
| 7,419,234 | B2 * | 9/2008 | London et al. | 347/7 |

FOREIGN PATENT DOCUMENTS

| | | |
|---|---|---|
| EP | 0789332 | 8/1997 |
| EP | 0854043 | 7/1998 |
| EP | 0882595 | 12/1998 |
| EP | 0940259 | 9/1999 |
| EP | 1004449 | 5/2000 |

* cited by examiner

*Primary Examiner* — Matthew Luu
*Assistant Examiner* — Brian Goldberg

(57) ABSTRACT

Techniques for spoofing an imaging device adapted for reading data from an electrical storage device to determine a volume of ink in an ink container include providing a replacement electrical storage device for use with the ink container, the replacement electrical storage device comprising memory locations; and responding, by the replacement electrical storage device, to reads of memory locations of the replacement electrical storage device by returning data to the imaging device which causes the imaging device to calculate an inaccurate initial volume of ink stored in the ink container.

8 Claims, 6 Drawing Sheets

FIG. 6

600

| PRIOR ART | PAGES PRINTED | WEIGHT (g) | GAUGE (%) | CARTRIDGE VOLUME | PRINTHEAD VOLUME | INK STATUS |
|---|---|---|---|---|---|---|
| | 0 | 34.29 | 100 | 11920 | 2995 | OK |
| | 13 | 33.33 | 100 | 11359 | 2848 | OK |
| | 25 | 33.33 | 100 | 11361 | 2053 | OK |
| | 37 | 33.33 | 100 | 11361 | 1255 | OK |
| | 49 | 31.66 | 100 | 9702 | 2623 | OK |
| | 62 | 30.52 | 98 | 8976 | 2778 | OK |
| | 74 | 30.52 | 91 | 8980 | 1982 | OK |
| | 86 | 30.52 | 84 | 8980 | 1185 | OK |
| | 98 | 28.88 | 81 | 7324 | 2554 | OK |
| | 110 | 28.88 | 74 | 7327 | 1757 | OK |
| | 122 | 27.13 | 70 | 5767 | 2996 | OK |
| | 134 | 27.13 | 63 | 5767 | 2198 | OK |
| | 146 | 27.13 | 57 | 5767 | 1397 | OK |
| | 158 | 25.11 | 53 | 4104 | 2776 | OK |
| | 173 | 25.11 | 47 | 4109 | 1983 | OK |
| | 185 | 24.45 | 40 | 4109 | 1186 | OK |
| | 197 | 23.30 | 24 | 1117 | 2552 | OK |
| | 209 | 23.30 | 17 | 1117 | 1755 | OK |
| | 221 | 22.05 | 12 | 372 | 1881 | OK |
| | 233 | 21.73 | 1 | 0 | 989 | * LOW ON INK |
| | 238 | 21.73 | 0 | 0 | 699 | * RESERVE |

602

| 50% | PAGES PRINTED | WEIGHT (g) | GAUGE (%) | CARTRIDGE VOLUME | PRINTHEAD VOLUME | INK STATUS |
|---|---|---|---|---|---|---|
| | 0 | 34.40 | 100 | 5470 | 2991 | OK |
| | 12 | 34.40 | 100 | 5470 | 2200 | OK |
| | 24 | 34.40 | 100 | 5470 | 1405 | OK |
| | 36 | 32.28 | 100 | 3806 | 2775 | OK |
| | 48 | 31.48 | 100 | 3252 | 2698 | OK |
| | 60 | 31.48 | 87 | 3253 | 1897 | OK |
| | 72 | 29.91 | 71 | 3253 | 1100 | OK |
| | 84 | 29.91 | 88 | 2951 | 2253 | OK |
| | 96 | 29.91 | 72 | 2951 | 1454 | OK |
| | 108 | 28.08 | 100 | 2950 | 2847 | OK |
| | 120 | 28.08 | 84 | 2951 | 2046 | OK |
| | 132 | 28.08 | 68 | 2951 | 1248 | OK |
| | 144 | 26.14 | 95 | 2950 | 2621 | OK |
| | 156 | 26.14 | 79 | 2951 | 1822 | OK |
| | 178 | 24.31 | 88 | 2950 | 2251 | OK |
| | 190 | 24.31 | 72 | 2951 | 1452 | OK |
| | 202 | 22.50 | 40 | 506 | 2377 | OK |
| | 214 | 22.50 | 24 | 507 | 1579 | OK |
| | 226 | 21.90 | 1 | 0 | 930 | * LOW ON INK |
| | 229 | 21.90 | 0 | 0 | 797 | * RESERVE |

604

| 150% | PAGES PRINTED | WEIGHT (g) | GAUGE (%) | CARTRIDGE VOLUME | PRINTHEAD VOLUME | INK STATUS |
|---|---|---|---|---|---|---|
| | 0 | 34.29 | 100 | 16400 | 2979 | OK |
| | 12 | 34.29 | 100 | 16400 | 2182 | OK |
| | 24 | 34.29 | 100 | 16400 | 1386 | OK |
| | 36 | 32.24 | 100 | 14725 | 2773 | OK |
| | 48 | 32.25 | 100 | 14726 | 1975 | OK |
| | 60 | 32.25 | 98 | 14726 | 1175 | OK |
| | 72 | 30.32 | 95 | 13060 | 2549 | OK |
| | 81 | 29.02 | 92 | 13060 | 1974 | OK |
| | 93 | 29.02 | 87 | 12227 | 2158 | OK |
| | 105 | 29.02 | 83 | 12227 | 1362 | OK |
| | 117 | 27.44 | 80 | 10535 | 2775 | OK |
| | 129 | 27.44 | 75 | 10538 | 1981 | OK |
| | 141 | 27.44 | 70 | 10538 | 1182 | OK |
| | 154 | 25.41 | 68 | 8878 | 2552 | OK |
| | 165 | 23.93 | 24 | 1705 | 2995 | OK |
| | 177 | 23.48 | 21 | 1247 | 2919 | OK |
| | 189 | 23.48 | 16 | 1249 | 2122 | OK |
| | 201 | 23.48 | 11 | 1249 | 1323 | OK |
| | 213 | 22.07 | 6 | 484 | 1407 | OK |
| | 225 | 21.66 | 0 | 0 | 971 | * LOW ON INK |
| | 228 | 21.66 | 0 | 0 | 839 | * RESERVE |

METHOD AND APPARATUS FOR SPOOFING IMAGING DEVICES

The present application is a continuation of allowed U.S. application Ser. No. 11/588,485 filed on Oct. 27, 2006 which is incorporated by reference herein in its entirety.

BACKGROUND

The present invention generally relates to imaging systems, and more particularly to apparatus and techniques for spoofing an imaging device.

One typical prior art ink-jet printing system includes a printer having a printhead and a replaceable ink container. The printhead receives a supply of ink from the replaceable ink container and, under the control of the printer, deposits or ejects drops of ink onto the print media to form images and text. The replaceable ink container may include an electrical storage device readable by the printer. The electrical storage device may store an ink scale parameter identifying an ink container volume range from a plurality of volume ranges. The electrical storage device may also store a fill proportion parameter identifying the proportion of the selected ink container volume range that represents the ink volume associated with the replaceable ink container. After reading the ink scale parameter and the fill proportion parameter from the electrical storage device, the printer determines the initial ink volume held in the replaceable ink container using these two parameters.

SUMMARY

In one aspect of the present invention, a method of spoofing an imaging device adapted for reading data from an electrical storage device to determine a volume of ink in an ink container comprises providing a replacement electrical storage device for use with the ink container, the replacement electrical storage device comprising memory locations; and responding, by the replacement electrical storage device, to reads of memory locations of the replacement electrical storage device by returning data to the imaging device which causes the imaging device to calculate an inaccurate initial volume of ink stored in the ink container.

Additionally, the replacement electrical storage device may comprise an ink container volume parameter specifying an ink volume range of the ink container; and an inaccurate fill proportion parameter in the replacement electrical storage device not indicative of a fill proportion for the selected ink volume range.

In another aspect of the present invention, a method spoofing an imaging device adapted for reading data from an electrical storage device to determine a volume of ink in an ink container comprises providing a replacement electrical storage device for use with the ink container, the replacement electrical storage device comprising memory locations; responding, by the replacement electrical storage device, to reads of memory locations of the replacement electrical storage device by returning at least partially inaccurate data to the imaging device; and calculating, by the imaging device, an incorrect initial volume of ink stored in the ink container.

In another aspect of the present invention, a method spoofing an imaging device adapted for reading data from an electrical storage device to determine a volume of ink in an ink container comprises providing a replacement electrical storage device for use with the ink container, the replacement electrical storage device comprising memory locations; and responding, by the replacement electrical storage device, to reads of memory locations of the replacement electrical storage device by returning an inaccurate fill proportion parameter to the imaging device.

A more complete understanding of the present invention, as well as further features and advantages of the invention, will be apparent from the following detailed description and the accompanying drawings.

BRIEF DESCRIPTION OF THE DRAWINGS

FIGS. 2A and 2B depict a schematic representation of the prior art ink-jet printing system shown in FIG. 1;

FIG. 6 shows three tables corresponding to the three curves of FIG. 5 in accordance with the present invention.

DETAILED DESCRIPTION

The following detailed description of preferred embodiments refers to the accompanying drawings which illustrate specific embodiments of the invention. In the discussion that follows, specific systems and techniques for spoofing an ink jet printer reading data from an electrical storage device associated with an ink container are disclosed. Other embodiments having different structures and operations for the spoofing of other types of imaging systems, such as laser printers, copiers, facsimile machines and the like, do not depart from the scope of the present invention.

Figure 1:
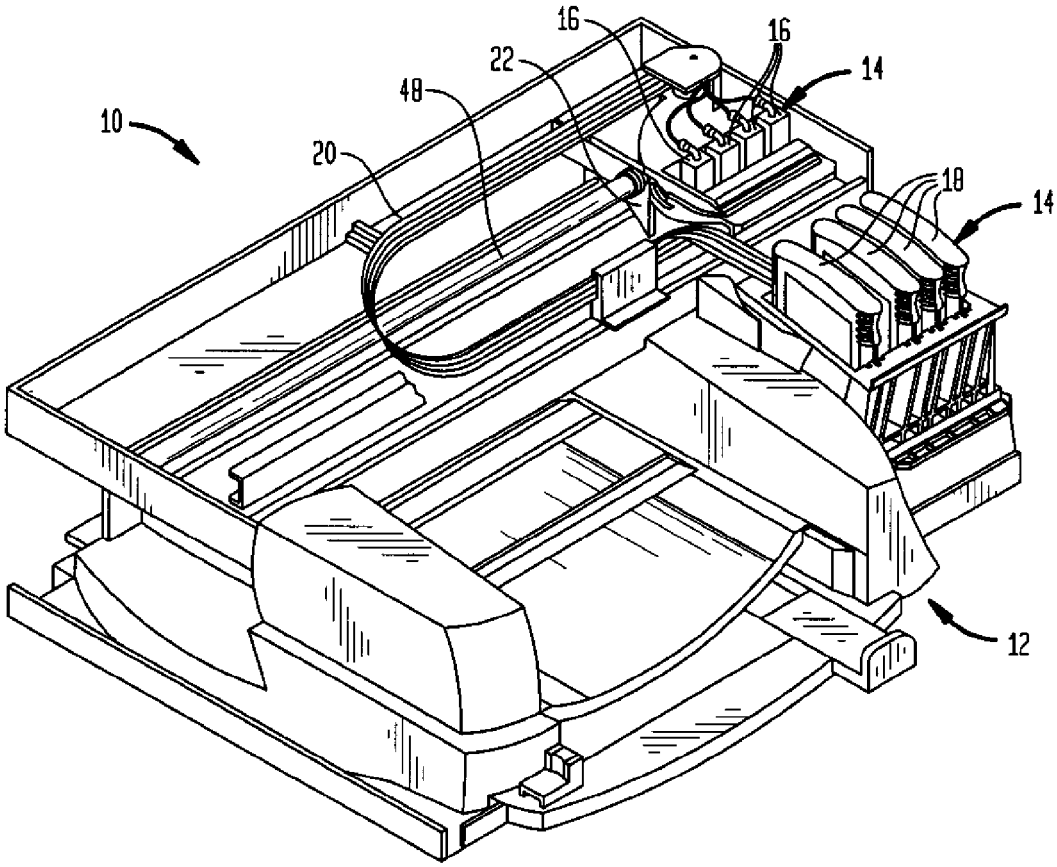
FIG. 1 (PRIOR ART)
FIG. 1 shows a perspective view of an exemplary prior art printing system shown with the cover removed.

FIG. 1 is a perspective view of one exemplary embodiment of a prior art ink-jet printing system 10 as disclosed in U.S. Pat. No. 6,089,687, which is incorporated by reference herein in its entirety. The prior art ink-jet printing system 10 includes a printer portion 12 having a plurality of replaceable printing components 14 installed therein. The plurality of replaceable printing components 14 include a plurality of printheads 16 for selectively depositing ink in response to control signals and a plurality of ink containers 18 for providing ink to each of the plurality of printheads 16. Each of the plurality of printheads 16 is fluidically connected to each of the plurality of ink containers 18 by a plurality of flexible conduits 20.

Each of the plurality of printheads 16 is mounted in a scanning carriage 22, which is scanned past a print media (not shown) as the print media is stepped through a print zone. As the plurality of printheads are moved relative to the print media, ink is selectively ejected from a plurality of orifices in each of the plurality of printheads 16 to form images and text.

The prior art ink-jet printing system 10 shown in FIG. 1 is configured to receive ink containers 18 having different ink volumes. This is accomplished using several methods, such as, the use of ink containers 18 that are different sizes with each size having a different volume associated therewith. Another technique for providing different ink volumes is to use ink containers 18 of the same size, but vary a volume of ink in each of the ink containers. The prior art teaches that it is critical that the ink container 18 provides a volume of ink that matches a proper use model for the particular application. Because ink jet inks typically have a limited storage life once inserted into the printer it is important that the ink container be sized sufficiently large to prevent inconveniencing the user with frequent ink container changes and sufficiently small to prevent ink from becoming stale with age. When ink-jet inks have exceeded the storage life and have become stale these inks cannot reliably produce high quality output images.

One aspect of the prior art system is a method and apparatus for storing information on the replaceable printing components 14 for updating operation parameters of the printer portion 12. An electrical storage device is associated with each of the replaceable printing components 14. The electrical storage device contains information related to the particular replaceable printer component 14. Installation of the replaceable printing component 14 into the printer portion 12 allows information to be transferred between the electrical storage device and the printing portion 12 to ensure high print quality as well as to prevent the installation of non-compatible replaceable printing components 14. The information provided from the replaceable printing component 14 to the printing portion 12 tends to prevent operation of the printing system 10 in a manner which damages the printing system 10 or which reduces the print quality.

Although the printing system 10 shown in FIG. 1 makes use of ink containers 18 which are mounted off of the scanning carriage 22, other types of printing system configurations may be utilized. One such configuration is one where the replaceable ink containers 18 are mounted on the scanning carriage 22. Alternatively, the printhead 16 and the ink container 18 may be incorporated into an integrated printing cartridge that is mounted to the scanning carriage 22.

Figure 2A:
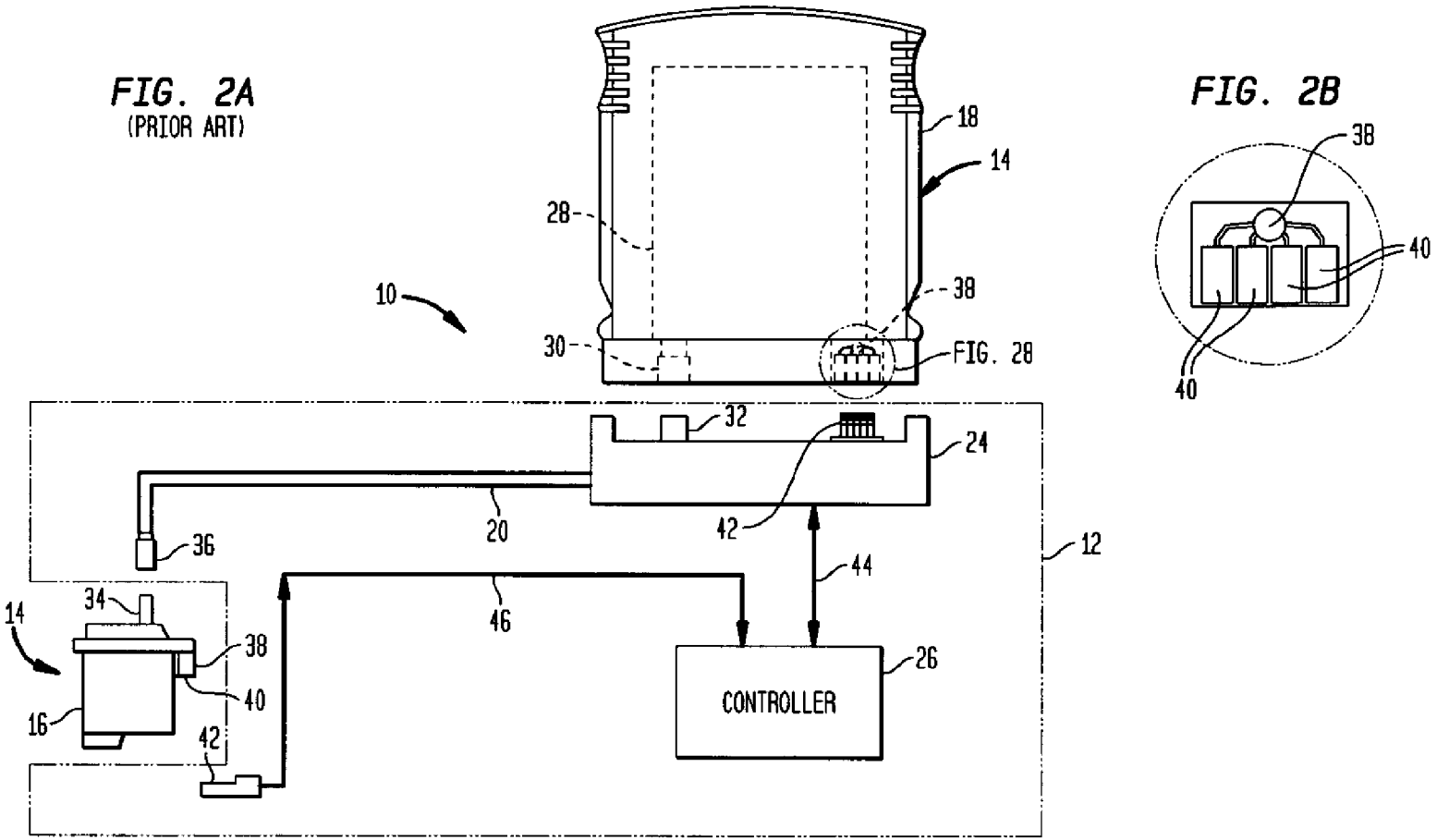
FIG. 2A (PRIOR ART)

FIGS. 2A and 2B depict a simplified schematic representation of the prior art ink-jet printing system 10 of the prior art shown in FIG. 1. FIGS. 2A and 2B are simplified to illustrate a single printhead 16 and a single ink container 18 for accomplishing the printing of a single color. For the case where more than one color is desired a plurality of printheads 16 are typically used each having an associated ink container 18 as shown in FIG. 1.

The prior art inkjet printing system 10 includes a printer portion 12 having replaceable printing components 14. The replaceable printing components 14 include a printhead 16 and an ink container 18. The printer portion 12 includes an ink container receiving station 24 and a controller 26. With the ink container 18 properly inserted into the ink container receiving station 24, an electrical and a fluidic coupling is established between the ink container 18 and the printer portion 12. The fluidic coupling allows ink stored within the ink container 18 to be provided to the printhead 16. The electrical coupling allows information to be passed between the ink container 18 and the printer portion 12 to ensure the operation of the printer portion 12 is compatible with the ink contained in the ink container 18 thereby achieving high print quality and reliable operation of the printing system 10.

The controller 26 controls the transfer of information between the printer portion 12 and the ink container 18. In addition, the controller 26 controls the transfer of information between the printhead 16 and the controller 26. Finally, the controller 26 controls the relative movement of the printhead 16 and the print media as well as selectively activating the printhead to deposit ink on print media. The controller 26 is typically implemented with a microprocessor or some form of programmable controller.

The ink container 18 includes a reservoir 28 for storing ink therein. A fluid outlet 30 is provided that it is in fluid communication with the fluid reservoir 28. The fluid outlet 30 is configured for connection to a complimentary fluid inlet 32 associated with the ink container receiving station 24.

The printhead 16 includes a fluid inlet 34 configured for connection to a complimentary fluid outlet 36 associated with the printing portion 12. With the printhead 16 properly inserted into the scanning carriage 22 (shown in FIG. 1) fluid communication is established between the printhead and the ink container 18 by way of the flexible fluid conduit 20.

Each of the replaceable printing components 14 such as the printhead 16 and the ink container 18 include an information storage device 38 such as an electrical storage device or memory 38 for storing information related to the respective replaceable printer component 14. A plurality of electrical contacts 40 are provided, each of which is electrically connected to the electrical storage device 38. With the ink container 18 properly inserted into the ink container receiving station 24, each of the plurality of electrical contacts 40 engage a corresponding plurality of electrical contacts 42 associated with the ink container receiving station 24. Each of the plurality of electrical contacts 42 associated with the ink container receiving station 24 are electrically connected to the controller 26 by a plurality of electrical conductors 44. With proper insertion of the ink container 18 into the ink container receiving station 24, the memory 38 associated with the ink container 18 is electrically connected to the controller 26 allowing information to be transferred between the ink container 18 and the printer portion 12.

Similarly, the printhead 16 includes an information storage device 38 such as an electrical storage device associated therewith. A plurality of electrical contacts 40 are electrically connected to the electrical storage 38 in a manner similar to the electrical storage device 38 associated with the ink container 18. With the printhead 16 properly inserted into the scanning carriage 22 the plurality of electrically contacts 40 engage a corresponding plurality of electrical contacts 42 associated with the printing device 12. Once properly inserted into the scanning carriage, the electrical storage device 38 associated with the printhead 16 is electrically connected to the controller 26 by way of a plurality of electrical conductors 46.

Although electrical storage devices 38 associated with each of the ink container 18 and the printhead 16 are given the same element number to indicate these devices are similar, the information stored in the electrical storage device 38 associated with the ink container 18 will, in general, be different from the information stored in the electrical storage device 38 associated with the printhead 16. Similarly, the information stored in electrical storage device 38 associated with each ink container of the plurality of ink containers 18 will in general be different and unique to the particular ink container of the plurality of ink containers 18. The particular information stored on each electrical storage device 38 will be discussed in more detail later.

Figure 3:
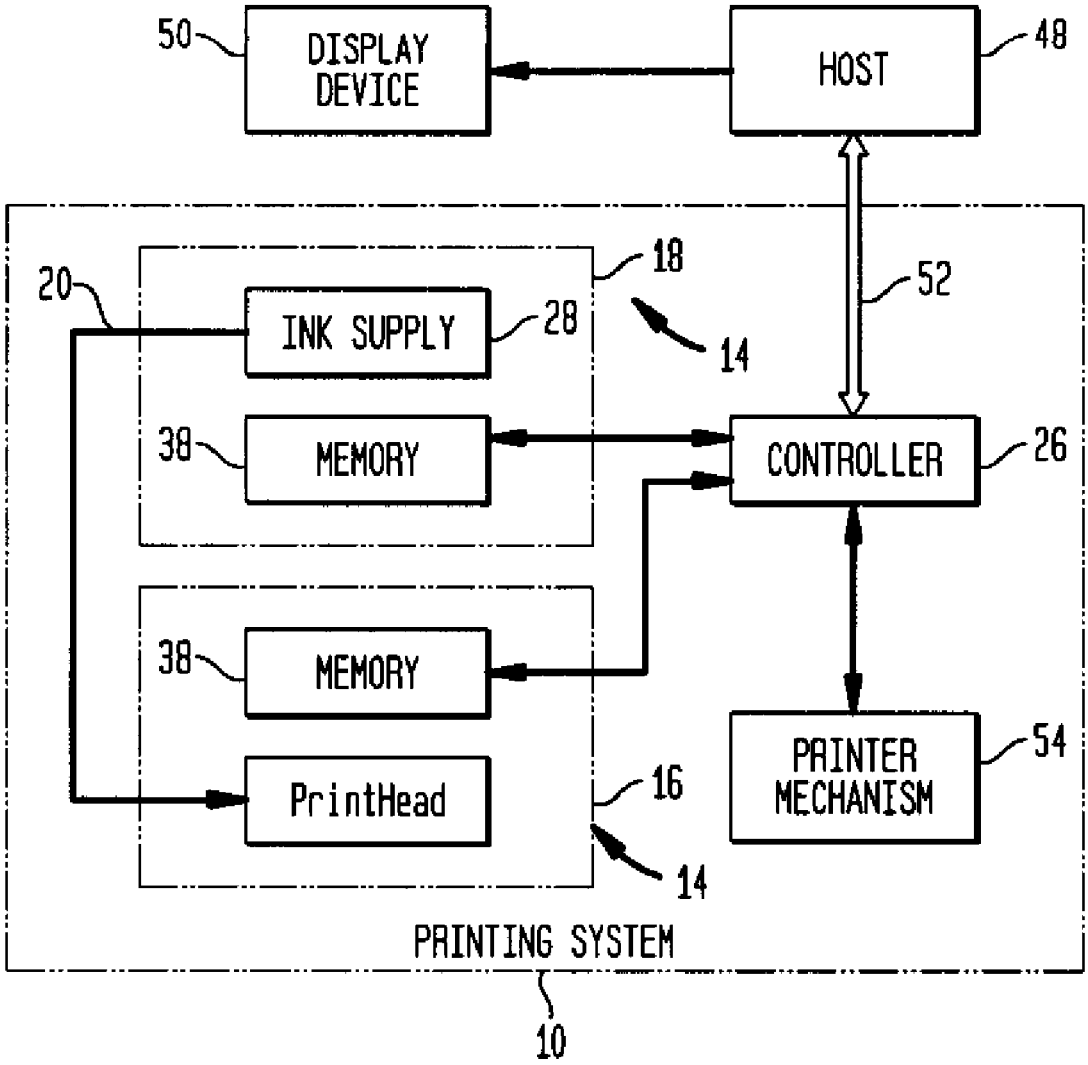
FIG. 3 (PRIOR ART)
FIG. 3 depicts a schematic block diagram of the ink-jet printing system of FIG. 1.

FIG. 3 represents a block diagram of the prior art printing system 10 shown connected to an information source or host computer 48. The host computer 48 is shown connected to a display device 50. The host 48 can be a variety of information sources such as a personal computer, work station, or server to name a few, that provides image information to the controller 26 by way of a data link 52. The data link 52 may be any one of a variety of conventional data links such as an electrical link or an infrared link for transferring information between the host 48 and the printing system 10.

The controller 26 is electrically connected to the electrical storage devices 38 associated with each of the printhead 16 and the ink container 18. In addition, the controller 26 is electrically connected to a printer mechanism 54 for controlling media transport and movement of the carriage 22. The controller 26 makes use of parameters and information provided by the host 48, the memory 38 associated with the ink container 18 and memory 38 associated with the printhead 16 to accomplish printing.

The host computer 48 provides image description information or image data to the printing system 10 for forming images on print media. In addition, the host computer 48 provides various parameters for controlling operation of the printing system 10, which is typically resident in printer control software typically referred to as the "print driver". In order to ensure the printing system 10 provides the highest quality images it is necessary that the operation of the controller 26 compensate for the particular replaceable printer component 14 installed within the printing system 10. It is the electric storage device 38 that is associated with each replaceable printer component 14 that provides parameters particular to the replaceable printer component 14 that allows the controller 26 to utilize these parameters to ensure the reliable operation of the printing system 10 and ensure high quality print images.

Among the parameters, for example which can be stored in electrical storage device 38 associated with the replaceable printing component 14 are the following: actual count of ink drops emitted from the printhead 16; a date code associated with the ink container 18; date code of initial insertion of the ink container 18; system coefficients; ink type/color: ink container size; age of the ink; printer model number or identification number; cartridge usage information; just to name a few.

The electrical storage device 38 shown in FIGS. 2A and 2B is a four terminal device. Alternatively, the electrical storage device 38 can be a two terminal device. One such two terminal device includes a power and ground terminals. Clock signals and data signals are provided on the power terminal.

The technique of the prior art allows ink volume information to be passed between the replaceable consumable 14 and the controller 26 in an efficient and reliable manner. The prior art teaches that it is frequently desirable to pass very accurate ink volume information between the replaceable consumable 14 and the controller 26. For example, in the case where the replaceable consumable 14 is the ink container 18, the prior art teaches it is necessary to have accurate ink volume information associated with the ink supply 28 passed to the controller 26 when the ink container 18 is initially inserted into the printing system 10. This information is used by the printing system 10 to compute remaining ink in the ink supply 28 based on ink usage. Therefore, the prior art teaches it is critical that very accurate ink volume information be associated with the ink supply 28 and that this information is accurately provided to the controller 26. The controller 26 uses this ink volume information as a basis for determining an out-of-ink condition. The prior art teaches it is important that this out-of-ink condition be determined accurately such that the printer is not operated without ink. Operation of the printer without ink can cause reliability problems or, if long enough, produce catastrophic failure.

The technique of the prior art must not only be capable of providing accurate ink volume information but also capable of providing accurate ink volume information over a large ink volume range. The ink volume range varies with the particular printing application. For example, large format printing requires ink containers that are typically several liters in size as a convenience to the user. Significantly smaller ink containers would require greater frequency of ink container replacement which if frequent enough can be an inconvenience to the user.

In the case of a desktop printer application for home use the ink container 18 may contain a significantly lower volume of ink on the order of 100 cubic centimeters (cc's) or less. Ink containers of larger volume for this application would likely exceed their shelf life or storage period thereby resulting in reduced print quality. In addition, ink use rate for a given application depends on the particular usage for the individual user.

The techniques of the prior art may be used for storing ink volume information in the electrical storage device 38. An ink scale parameter is first determined for the ink volume associated with the ink container 18. The ink scale parameter identifies an ink container volume range from a plurality of ink container volume ranges. The ink container scale parameter may be a two-bit binary value that is used to uniquely identify each of four ink container volume ranges. For example, the two-bit binary value of 00 may represent an ink container volume range from 0-255.75 cubic centimeters (cc's), a value of 01 may represent an ink container volume range from 0-511.50 cc's, a value of 10 may represent a value of 10 may represent an ink container volume range of 0-1023 cc's, and an ink container scale parameter value equal to 11 may represent an ink container volume range from 0-2,046 cubic centimeters.

A fill proportion parameter is then determined for the supply of ink for the ink container 18. The fill proportion parameter identifies the proportion of the selected ink container volume range that represents the ink volume associated with the ink container 18. The fill proportion parameter may be a 10-bit binary value. This 10-bit binary value can uniquely identify up 1,024 unique values. An ink volume resolution associated with the ink container 18 then varies with the ink container volume range.

The ink scale and the fill proportion parameters are stored in the electrical storage device 38 associated with the ink container 18.

As discussed previously, the printing system 10 is capable of accepting ink containers 18 that have varying ink container volumes. The technique of the prior art allows the particular ink volume associated with the ink container 18 to be accurately specified using minimal resources in the electrical storage device 38.

In operation, the printing system when powered up or when the ink container 18 is newly installed represented by step 64 a memory read request is initiated by the controller 26. This read request directs the electrical storage device 38 to provide the ink container scale parameter and the fill proportion parameter to the controller 26. The controller 26 interprets this information to determine the volume of ink associated with the ink container 18. The printing system 10 is then ready for accepting a print command from the host. Further details of the prior art printing system are provided in U.S. Pat. No. 6,089,687.

As described above, after reading the ink scale parameter and the fill proportion parameter from the electrical storage device 38, the printer 10 determines the initial ink volume held in the ink container 18 using these two parameters. The printer 10 may then use a computational drop count technique to estimate and report to the user the amount of ink remaining during the use of the ink container 18. To prevent the printhead 16 from running dry, the printer 10 may use a separate, physical measurement system (possibly separate from the computational technique and not dependent on the initial volume determination) that actually determines when the ink container 18 is low or out of ink, and then halts printing to prevent damage to the printhead 16.

The present invention provides techniques for spoofing or deceiving a printer by causing the printer to calculate an incorrect initial volume of ink held in the ink container 18. In various situations it may be advantageous to spoof the printer regarding the initial volume of ink stored in an ink container. By causing the printer calculate an inaccurate initial volume of ink greater than the actual volume of ink remaining, the printer may report to the user a greater amount of ink remaining. Conversely, by causing the printer calculate an inaccurate initial volume of ink less than the actual volume of ink remaining, the printer may report to the user a lesser amount of ink remaining. Such inaccurate reporting may be advantageous in order to modify customer behavior, meet customer expectations or confuse competitors.

Figure 4:
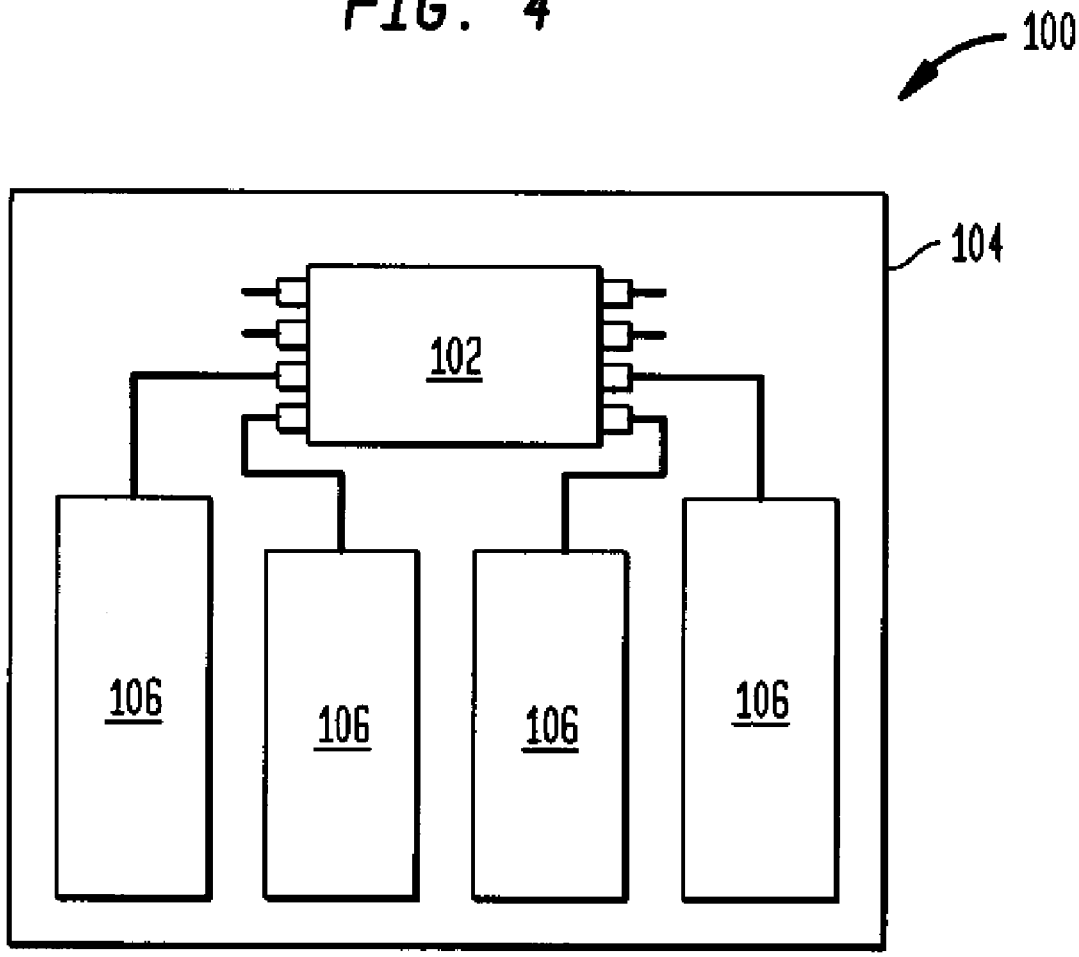
FIG. 4 shows a circuit comprising a replacement electrical storage device in accordance with the present invention.

FIG. 4 shows a circuit 100 in accordance with the present invention. The circuit 100 comprises a replacement electrical storage device 102 and contacts 106 attached to a circuit board 104. The replacement electrical storage device 102 may be suitably implemented as a memory device, a custom or semi-custom integrated circuit, a programmable gate array, a microprocessor, a microcontroller, or the like. The circuit 100 may be utilized as a replacement for the electrical storage device 38 and associated components of the prior art and may be attached to the ink container 18 when the ink container 18 is refilled with ink. Alternatively, the circuit 100 may be attached to a new ink container 18.

The replacement electrical storage device 102 may mimic at least a subset of the operation and functionality of electrical storage device 38 in order to allow operation of the printer system 10 with a refilled ink container 18 or a new ink container 18 having the device 102. For example, the replacement electrical storage device 102 may operate as a memory element, allowing read and write accesses to various memory locations. For certain memory locations in the replacement electrical storage device 102 which are read by the printer system 10, the electrical storage device 102 may store (and provide to the printer) the same data stored in the electrical storage device 38. For other memory locations in the replacement electrical storage device 102 which are read by the printer system 10, the electrical storage device 102 may store (and provide to the printer) data which differs from the data stored in the electrical storage device 38.

Figure 5:
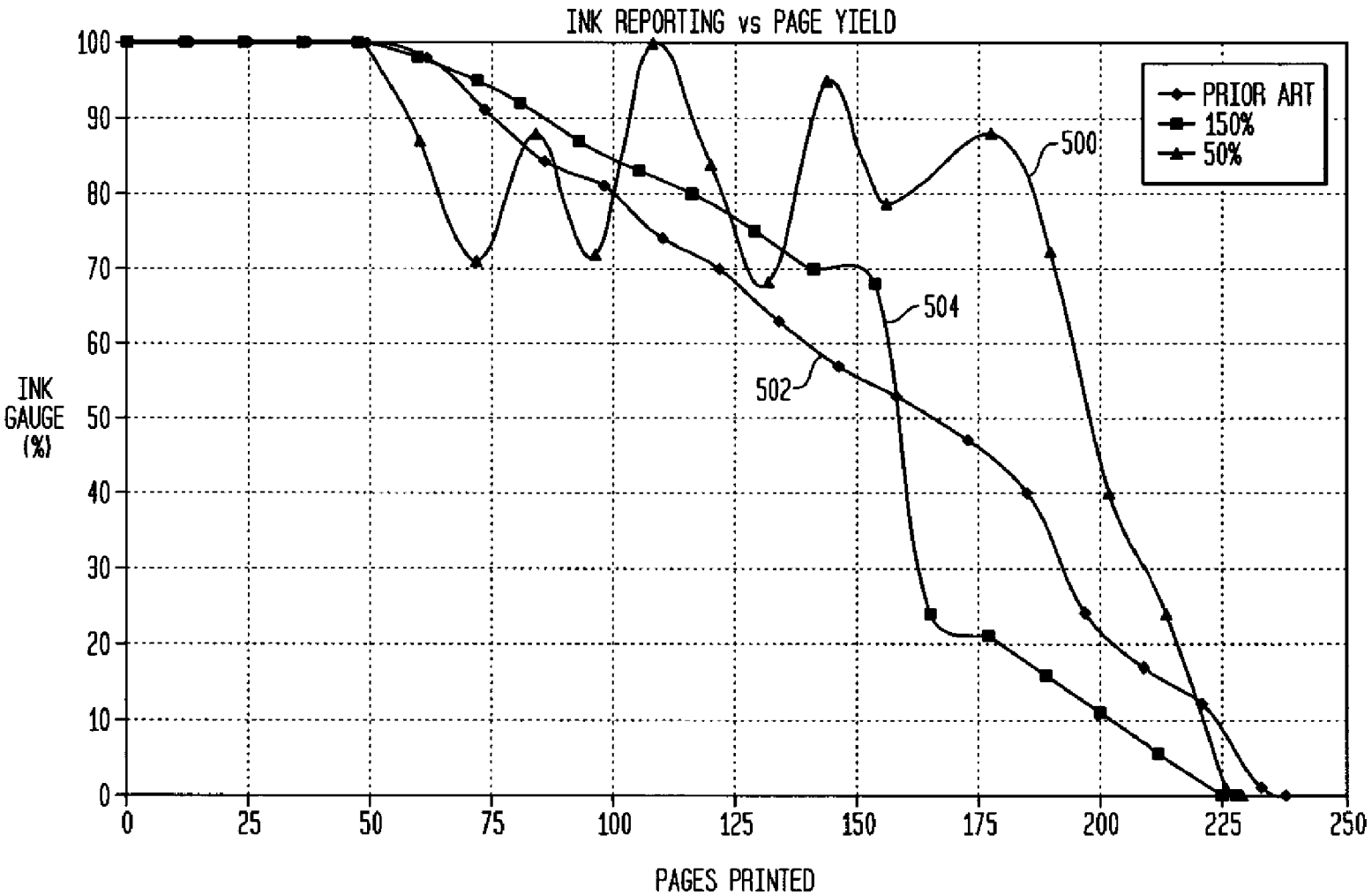
FIG. 5 shows a graph of the percentage of ink remaining as reported by the printer for different initial ink volume determinations in accordance with the present invention.

To spoof the printer system 10 into determining an inaccurate initial volume of ink stored in the ink container, the replacement electrical storage device 102 may return to the printer system 10 an inaccurate fill proportion parameter which is not indicative of a fill proportion for a selected ink volume range. For example, if the fill proportion parameter is 50% of the accurate fill proportion parameter, the printer system 10 will calculate an inaccurate initial volume of ink stored in the ink container 18 which is generally 50% of the actual initial volume of ink. FIG. 5 depicts a graph of the percentage of ink remaining as reported by the printer for different initial volume determinations. Curve 500 of FIG. 5 shows the ink remaining percentage of the ink container 18 for the case of the inaccurate initial ink volume determination of 50% of the actual ink volume, in comparison to curve 502 which corresponds to the prior art determination of the accurate initial ink volume. Additionally, if the fill proportion parameter is 50% of the accurate fill proportion parameter for a particular ink tank size, the ink container volume parameter specifying an ink volume range of the ink container 18 may be doubled, causing the printer system 10 to calculate an inaccurate initial volume of ink stored in the ink container 18 which is 150% of the actual volume of the ink held in the ink container 18. Curve 504 of FIG. 5 shows the ink remaining percentage of ink container 18 for the case of the inaccurate initial ink volume determination of 150% of the actual initial ink volume.

Note that while both curves 500, 502 and 504 begin at 100% in FIG. 5, the printer 10 believes that the ink container 18 having the inaccurate fill proportion parameter of 50% was initially filled with a volume of ink generally 50% that of the actual ink volume. Additionally, the printer 10 believes that the ink container 18 having both the fill proportion parameter is 50% of the accurate fill proportion parameter for a particular ink tank size and the doubled ink container volume parameter was initially filled with a volume of ink generally 150% of the actual ink volume. See Tables 600, 602 and 604 of FIG. 6 showing cartridge (ink container) volume as determined by the printer for these three cases, where the actual initial ink volume for each case is approximately the same, but the initial ink volume determined by the printer varies significantly.

Thus, by setting either or both of the fill proportion parameter and the ink container volume parameter to an inappropriate value, the printer system 10 is spoofed into making an inaccurate determination of the initial volume of ink stored in the ink container 18. Additionally, as ink is consumed during the printing process, the printer will continue to report to the user a generally inaccurate amount of ink remaining until an ink low situation is detected, as seen in FIG. 5.

Although specific embodiments have been illustrated and described herein, those of ordinary skill in the art appreciate that any arrangement that is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A system for spoofing an imaging device adapted for reading data from an electrical storage device to determine a volume of ink in an ink container, the system comprising:

a replacement electrical storage device for use with the ink container, the replacement electrical storage device comprising memory locations, wherein the replacement electrical storage device responds to reads of memory locations of the replacement electrical storage device by returning inaccurate data to the imaging device which causes the imaging device to calculate an inaccurate initial volume of ink stored in the ink container.

2. The system of claim 1 wherein the data returned to the imaging device from the replacement electrical storage device comprises:

an ink container volume parameter specifying an ink volume range of the ink container; and an inaccurate fill proportion parameter in the replacement electrical storage device not indicative of a fill proportion for the selected ink volume range.

3. The system of claim 2 wherein the inaccurate fill proportion parameter is greater than an accurate fill proportion parameter, and wherein the inaccurate fill proportion parameter causes the imaging device to calculate an inaccurate volume of ink stored in the ink container greater than an actual volume of ink stored in the ink container.

4. The system of claim 2 wherein the inaccurate fill proportion parameter is less than an accurate fill proportion parameter, and wherein the inaccurate fill proportion parameter causes the imaging device to calculate an inaccurate volume of ink stored in the ink container less than an actual volume of ink stored in the ink container.

5. The system of claim 2 wherein the calculation of the inaccurate initial volume of ink stored in the ink container causes the imaging device to calculate an inaccurate amount of ink remaining through at least a portion of the use of the ink container.

6. The system of claim 2 wherein the ink container volume parameter specifies an inaccurate ink volume range of the ink container.

7. A system of spoofing an imaging device adapted for reading data from an electrical storage device to determine a volume of ink in an ink container, the system comprising:

a replacement electrical storage device for use with the ink container, the replacement electrical storage device comprising memory locations, wherein the replacement electrical storage device responds to reads of memory locations of the replacement electrical storage device by returning at least partially inaccurate data to the imaging device, and wherein the partially inaccurate data causes the imaging device to calculate an incorrect initial volume of ink stored in the ink container.

8. A system of spoofing an imaging device adapted for reading data from an electrical storage device to determine a volume of ink in an ink container, the system comprising:

a replacement electrical storage device for use with the ink container, the replacement electrical storage device comprising memory locations, wherein the replacement electrical storage device responds to reads of memory locations of the replacement electrical storage device by returning an inaccurate fill proportion parameter to the imaging device, and wherein the inaccurate fill proportion parameter causes the imaging device to calculate an incorrect volume of ink stored in the ink container.

* * * * *